US005377599A

United States Patent [19]

Wall et al.

[11] Patent Number: 5,377,599

[45] Date of Patent: Jan. 3, 1995

[54] ADJUSTABLE MOUNT DEVICE FOR PRE-INKED HAND STAMP

[76] Inventors: Alexander C. Wall, 705 Bayshore Rd., Nokomis, Fla. 33555; Steven J. Sculler, 14 Dartmoor Dr., Manalapan, N.J. 07726

[21] Appl. No.: 123,784

[22] Filed: Sep. 20, 1993

[51] Int. Cl.[6] ..... B41K 1/38

[52] U.S. Cl. ..... 101/327; 101/405; 101/368; 101/333

[58] Field of Search ..... 101/103, 104, 125, 327, 101/333, 368, 371, 405

[56] References Cited

U.S. PATENT DOCUMENTS

| | | | |
|---|---|---|---|
| D. 266,257 | 9/1982 | Ahrens | 101/405 X |
| 1,179,979 | 4/1916 | Troup | 101/371 |
| 1,196,512 | 8/1916 | Brookman | 101/405 |
| 2,778,306 | 1/1957 | Harris | 101/333 |
| 2,900,902 | 8/1959 | Becker | 101/368 |
| 4,022,127 | 5/1977 | Carlsson et al. | 101/327 |
| 4,172,419 | 10/1979 | Munyon | 101/379 |
| 4,203,362 | 5/1980 | Underwood | 101/327 |
| 4,362,101 | 12/1982 | Ahrens | 101/327 |
| 4,594,943 | 6/1986 | Netteshelm et al. | 101/327 |
| 4,649,819 | 3/1987 | Voto, Jr. et al. | 101/327 |
| 4,735,143 | 4/1988 | Weir | 101/333 |
| 5,111,745 | 5/1992 | Wilson | 101/333 |
| 5,115,729 | 5/1992 | Beckman et al. | 101/327 |

FOREIGN PATENT DOCUMENTS

| | | | |
|---|---|---|---|
| 2157626 | 10/1985 | United Kingdom | 101/327 |
| 2226276 | 3/1988 | United Kingdom . | |

*Primary Examiner*—David A. Wiecking
*Assistant Examiner*—Christopher A. Bennett
*Attorney, Agent, or Firm*—Albert C. Johnston

[57] ABSTRACT

In a hand stamp mount device especially suitable for a preinked stamp impression member that can give great numbers of imprints, the downstroke distance of a substantially rigid, non-rotatable assembly of a handle, a stem and a platen for carrying the impression member is adjustable precisely by turning with one's fingers an adjuster that correspondingly turns a stroke limiting stop member and causes it upon turning to be displaced proportionately lengthwise of the stem. Several ways of effecting the adjustments are disclosed, including some which eliminate all need for screw-threaded parts by making use of a molded ramp member presenting helical ramp surfaces. The platen and a case enclosing it are stiffened to resist stamping forces by an array of integral radiating ribs protruding upwardly from the platen and another array of such ribs protruding downward from the top of the case; and the ribs of the two sets intercalate to occupy vertical space in common when the platen is in normal upward position. A cover closing the case presents structures which limit downward movement of the platen, and structures connecting the cover with the case resist removal of the cover otherwise than by force applied to an end thereof. Further, the handle of the device is provided with an asymmetrically rounded knob form enabling reliance on the feel of it in a user's hand for securing right-reading stamped imprints.

20 Claims, 6 Drawing Sheets

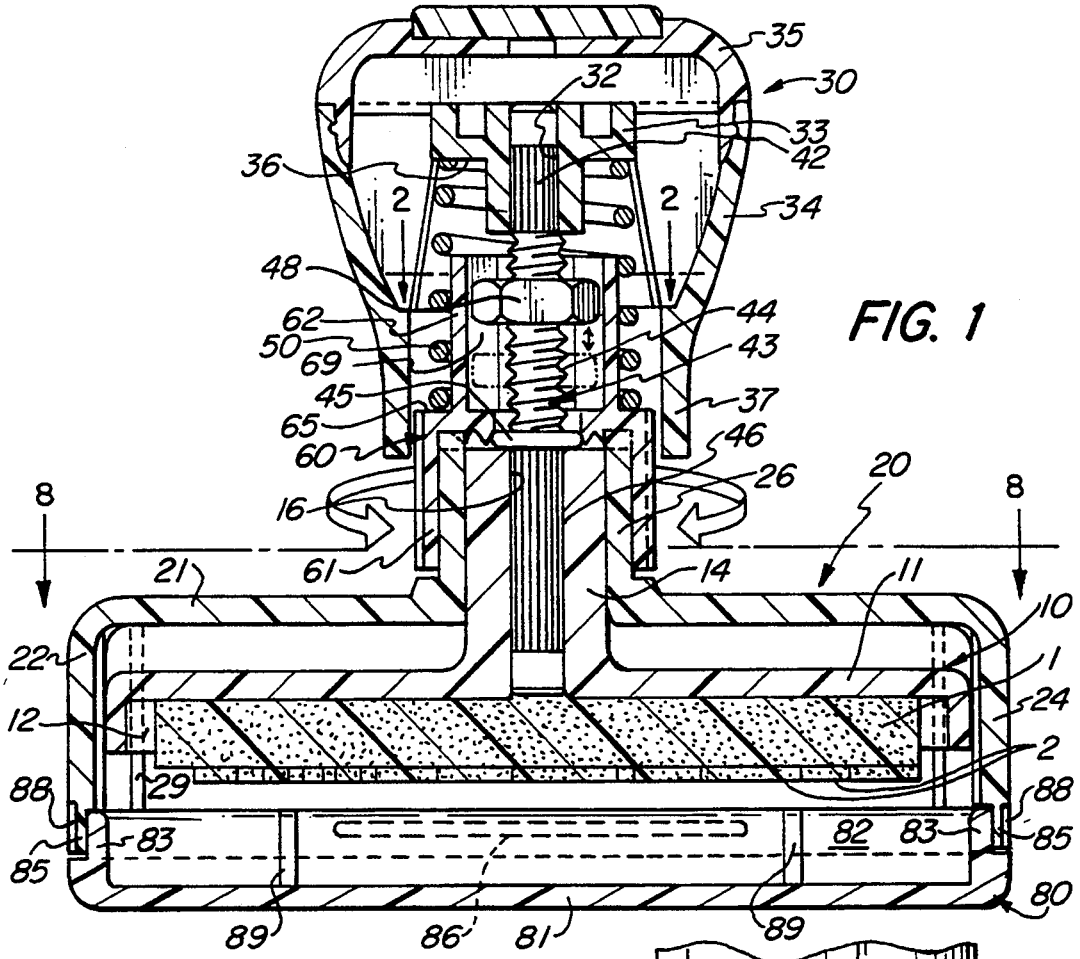
FIG. 1
FIG. 2
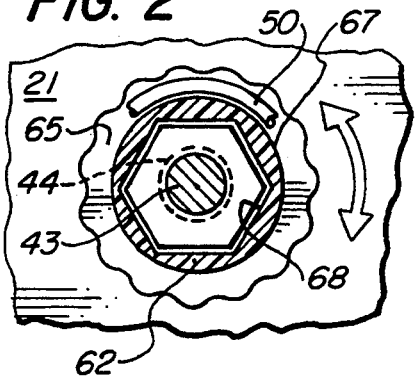
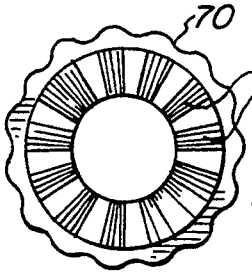
FIG. 4
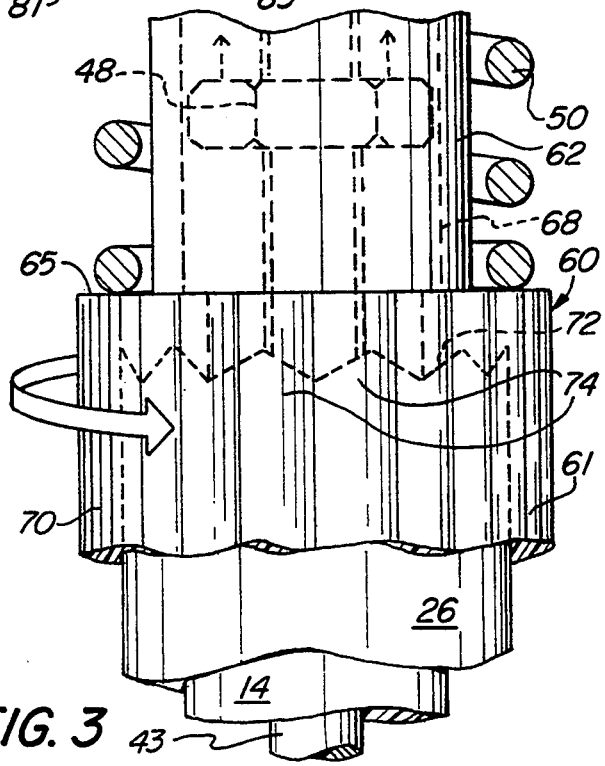
FIG. 3

FIG. 8
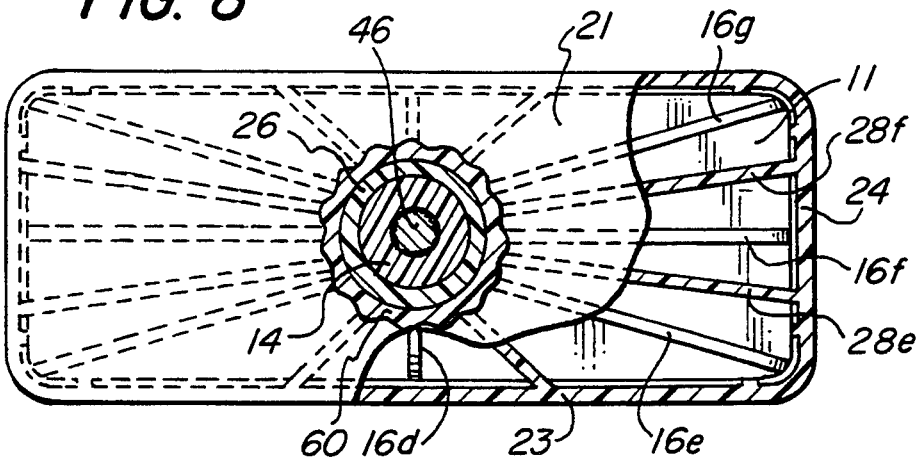
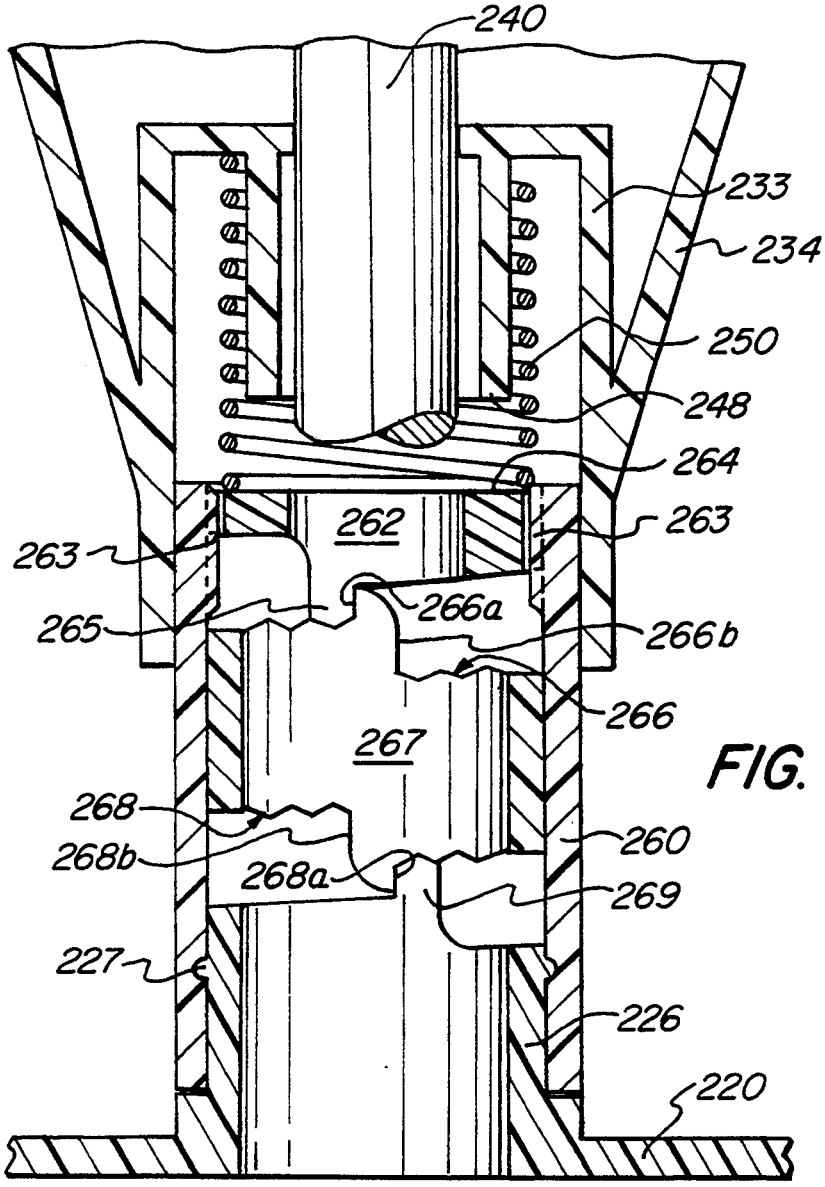
FIG. 12

ADJUSTABLE MOUNT DEVICE FOR PRE-INKED HAND STAMP

FIELD OF THE INVENTION

This invention relates to an adjustable mount device for a preinked hand stamp of the kind making use of an impression member having a microporous structure impregnated with ink and capable under compression of releasing ink gradually so that, without further inking, large numbers of imprints can be made of indicia, or type elements, presented in relief on the impression member.

DESCRIPTION OF PRIOR ART

Such preinked stamps typically comprise a platen to which the impression member is fixed, a case that houses the platen, a handle disposed over the case and a shaft or stem interconnecting the handle and the platen to form a reciprocable assembly therewith. A spring normally holds the handle assembly in an upward position with the platen and an impression member thereon disposed entirely inside the case; yet the assembly is displaceable downward against the spring by pressure of a user's hand on the handle so that the impression member will mark a surface underlying the case. The distance of downward travel, or stroke, of the handle assembly is limited by abutment of a stop member carried with the handle against a stop member supported by the case, and at least one of these stop members is made adjustable in location lengthwise of the stem so that the permitted stroke length of the assembly can be changed when need occurs. A light imprint results if the downward stroke does not compress the stamp indicia sufficiently, while an overly dark or smudged imprint may result if the indicia are compressed too much.

Accordingly, it is important that the distance of downward travel of the impression member on each stroke of the handle assembly be suited for the inking capability of the impression member at each time of the use of the stamp, with that distance being readily adjustable to enable lower compression when the impression member holds an abundant store of ink and greater compression when the store of ink in the impression member has decreased.

It is important, too, that inadvertent or unintended changes of the stroke adjustment of the handle assembly be avoided.

Further, since users of a hand stamp will press its handle downward with forces that may vary greatly in magnitude and will also vary in direction from straight up and down, the quality of the imprints to be obtained in uses of the stamp is influenced by the degree to which its structures will function correctly irrespective of the magnitude and the angle of the force applied to the handle by a user. It is of course important in this regard, and in others as well, to keep the structures of the stamp light in weight and relatively inexpensive to manufacture and assemble.

Economical production similarly is desired in respect of the means provided for adjusting the stroke of the handle assembly. Hand stamps as currently produced, for the most part, make use of a screw-threaded arrangement of some kind to adjust the downward stop position of the platen. Specially threaded molded plastic parts, which tend to be costly and of modest strength, or threaded metal parts made on a screw machine, usually are employed. Such metal parts are strong but expensive, and relatively expensive assembly of them to molded plastic parts may be required.

Yet another desideratum of a preinked hand stamp is that its appearance and the feel of it in one's hand may facilitate accurate positioning of the stamp for making an imprint and may minimize or eliminate occasions of a user positioning the stamp and pressing it down to mark a surface beneath it only to find that an upside-down imprint is made due to the stamp being oriented backwards.

Still other desiderata relate to the provision of reliable means of securing a cover over the lower side of the stamp's case, to close off the inked impression member from free air and prevent it from soiling nearby articles or one's hands with ink when the stamp is not in use; and relate to structures whereby inadvertent downward movement of the platen by the handle assembly when the cover is in place will be obstructed to keep the impression member from reaching and soiling the cover.

SUMMARY OF THE INVENTION

The principal object of the present invention is to provide a new and improved adjustable mount device for a hand stamp impression member, and particularly for such a member of the preinked type suitable for making great numbers of stamped imprints, whereby one or more of, or even substantially all, the important functions or desiderata mentioned above can be achieved.

The foregoing and other objects and advantages of the invention and particulars of the ways herein provided for achieving them will be apparent from the following detailed description and the accompanying illustrative drawings of the invention.

BRIEF DESCRIPTION OF THE DRAWINGS

In the drawings:

FIG. 1 is a longitudinal vertical cross-sectional view of a mount device embodying the invention, showing an ink-impregnated impression number fixed to the platen of the device and showing a cover in place over the lower side of the case;

FIG. 2 is a fragmentary horizontal cross-sectional view taken at line 2—2 of FIG. 1, showing an upper portion of the stroke adjuster and, inside it, a stop member adjustably positioned on a stem interconnecting the handle and the platen;

FIG. 3 is an enlarged fragmentary view of the adjuster, partly broken away to show the toothed interengagement of an inner ring portion of the adjuster with the end of an upstanding sleeve portion of the case of the stamp;

FIG. 4 is a fragmentary plan view of the toothed end of said sleeve portion;

FIG. 8 is a horizontal sectional view taken along line 8—8 in FIG. 1 to show partly in plan view and partly in section the relationships of reinforcing structures of the case and the platen of the device;

FIG. 12 is a view similar to that of FIG. 9 showing a modification of the embodiment making use of followers engaged with helical ramp surfaces, whereby turning of the adjuster to adjust the stroke of the handle assembly causes no change of the axial position of the adjusters.

DESCRIPTION OF THE PREFERRED EMBODIMENTS

Figure 6:
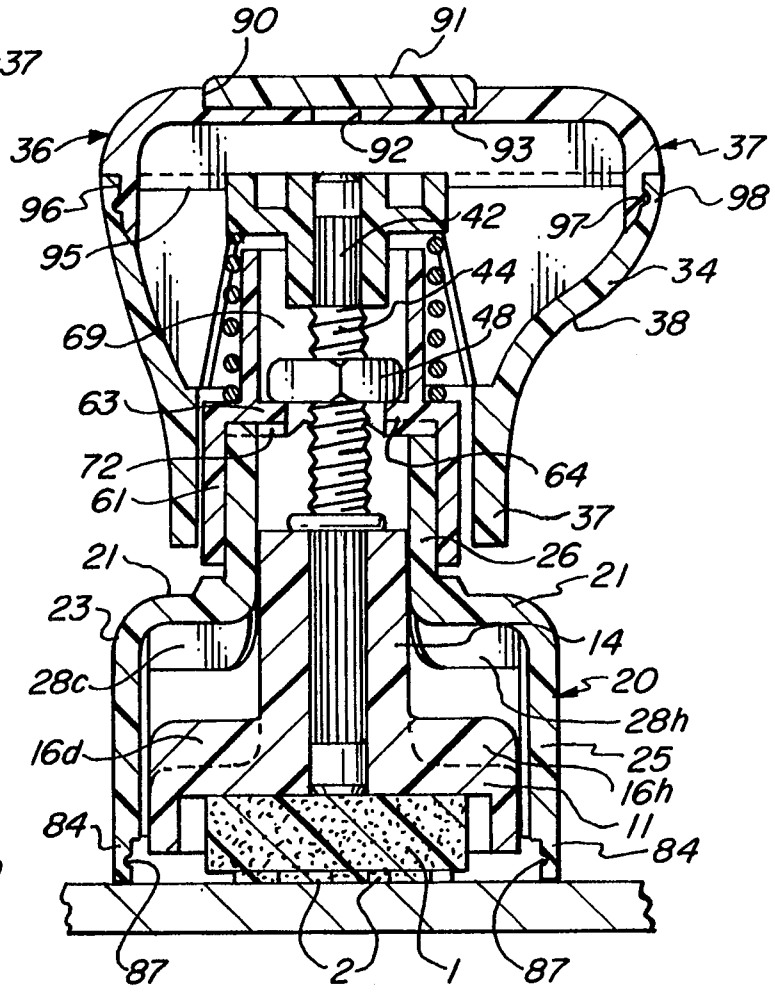
FIG. 6 is a view similar to FIG. 5 but showing the device with its cover removed and the handle assembly depressed for marking the surface under the device.

FIGS. 1 through 8 of the drawings illustrate the assembly of parts and particulars of a preferred embodiment of the invention.

As seen in FIG. 1, the adjustable stamp mount comprises a platen 10 which is adapted to support and carry on its under side a stamp impression member 1 presenting indicia, or stamp elements, 2 formed in relief on its structure. The impression member 1 typically has a compressible microporous structure that is impregnated with ink and capable under compression of releasing ink into and through the indicia so that they form an inked imprint when pressed against a surface to be stamped.

The platen 10 with an impression member affirmed to it is housed in a case 20 which is a molded body made of a hard resilient material such, for example, as an ABS resin. The platen, too, and other molded parts of the stamp mount may be made of the same or a similar hard resilient material, such as a thermoplastic ABS resin.

The case comprises a top wall 21 overlying the platen 10 and has side and end panels 22, 23, 24 and 25 extending downward near to side and end flanges 12 that extend downward from the main panel 11 of platen 10. Disposed over the case 40 is a handle generally indicated at 30, which is connected securely with the platen 10 by a stem 40 (FIG. 7) that extends downward through a sleeve portion 26 standing up from top wall 21 of the case 20.

More particularly, the stem 20 has a knurled upper end portion 42 that is force-fitted into a socket 32 formed in an inner body portion 33 of the handle. A mid-portion 43 of the stem is formed with a spiral external screw thread 44, and a knurled lower stem portion 46 is force-fitted into a socket 16 formed in an upstanding central portion 14 of the platen 10. Platen portion 14 is received slidably in sleeve portion 26 of the case. A radial shoulder 45 on the stem borders the lower end of the threaded mid-portion 43 and, by butting against the upper end of central portion 14 of platen 10, limits the distance of the forcing of the stem's lower end portion 46 into the platen's socket 16.

The inner body portion 33 of the handle 30 is molded as an integral part of a handle body 34 onto which a molded cap 35 is fitted, preferably removably as described further hereinafter.

The platen 10 and handle 30 as interconnected by stem 40 constitute a substantially rigid assembly that is movable up and down relative to the case 20 within certain limits. The upward movement of the handle assembly is limited by the abutment of portions of the platen 10 against the top wall 21 of case 20. The handle assembly thus has a limiting upward position, in which platen 10 and an impression member 1 thereon are disposed entirely inside case 20; and it normally is held in that position by a coiled wire spring 50 disposed inside handle body 34. The spring 50 is compressed between a downwardly facing shoulder 36 formed on inner body portion 33 of the handle and an upwardly facing shoulder 65 formed on a stroke adjuster 60.

The adjuster 60 has a lower cylindrical portion 61 that encompasses and is seated upon and turnable about the upstanding sleeve portion 26 of case 20.

An upper adjuster portion 62 extends along and is spaced from the screw threaded portion 43 of stem 40, and is connected with lower portion 61 by a radial portion 63 that extends over the end of sleeve 26 and thence inward to present a ledge 64 underlying a stop member 48 provided on the threaded portion 43 of stem 40.

The stop member 48 is internally screw-threaded to fit and be adjustable up and down on the stem's spiral thread 44. Member 48 may be, for example, a conventional hexagonal nut of a small size and kind readily available in any hardware store at very low cost.

The stem 40, too, may be provided relatively inexpensively, for its threaded portion 43 need not be of screw machine precision. It can be and preferably is made simply by rolling its thread 44 and other formations into a length of heavy wire, such, for example, as wire of about 0.16 inch in diameter made of a 1018–1022 steel.

The upper adjuster portion 62 has a cylindrical outer side 67 disposed inside the spring 50. Its inner side 68 is spaced a small distance from the outer edge of stop member 48 and is made of polygonal, e.g., hexagonal, cross-section so that a turning of the adjuster 60 about the axis of stem 40 will cause the upper adjuster portion to turn the stop member correspondingly about the stem. At the same time, a proportional displacement of stop member 48 lengthwise of the stem is caused by the spiral form of the thread 44 onto which the stop member 48 is threaded.

The space 69 between threaded stem portion 43 and the inner side 68 of adjuster portion 62 constitutes a pathway in which the stop member 48 can be moved up and down either by movement of the handle assembly up and down relative to case 20 or, when desired, by turning the adjuster 60 incrementally to change the location of stop member 48 lengthwise of the stem 40. It will be noted that for any given location of stop member 48 on stem 40 there is a certain distance of downward movement of the handle assembly, and a corresponding degree of compression of an impression member 1 carried on platen 10, that can occur before such movement is stopped by engagement of stop member 48 against the underlying ledge 64 which normally is held seated relative to case 20. That distance can be adjusted as desired simply by turning adjuster 60 incrementally about the sleeve portion 26 of case 20.

Such turning of the adjuster is facilitated by the location of its lower portion 61 in space normally present between the case wall 21 and the handle body 34, where the adjuster is readily engageable between a user's fingers. Vertical flutes 70 on the outer side of portion 61 also aid turning of the adjuster. It will be noted, however, that when the handle assembly is pressed downward to make an imprint, thus reaching a position like that illustrated in FIG. 6, a collar portion 37 of the handle body covers much of adjuster portion 61 so that inadvertent turning of the adjuster is not likely to occur.

Moreover, to enable accurate control of the adjustments yet avoid inadvertent or unintended turning of the adjuster, the radial portion 63 overlying the end of sleeve 26 is formed about its underside with a circular series 72 of regularly formed downwardly directed detents, or teeth, each having convergent sides sloped at an angle, for example, of about 30° relative to the horizontal; and the upper end of sleeve 26 is formed with a mating circular series 74 of similarly shaped upwardly directed detents, or teeth. The force of spring 50 bearing against ledge 65 normally holds the detents on adjuster portion 63 in mesh with the set 74 of detents on sleeve portion 26 of case 20. Since this spring force increases as the handle assembly is depressed in a use of the stamp to make an imprint, there then is increased resistance of the structure to inadvertent change of the stroke distance adjustment. Yet when the stamp is not in use, the adjuster can be turned easily to make incremental adjustments of the stroke distance and the degree of compression of the impression member that will occur upon resumed use of the stamp.

The form, arrangement and biasing of the meshing detents preferably are such that each toothwise increment of displacement of the detents of set 72 relative to those of set 74 gives a sensible feel and a clicking which enable precise determination of the extent of each turning movement of the adjuster 60 and thus of each adjustment of the length of the stroke of the handle assembly.

It will be apparent that when the stamp is being used downward forces applied to the handle 30 will be transmitted to the platen 10 via its central portion 14 to cause compression of the impression number 1. Then, when stop member 48 has butted against ledge 64 (as indicated in FIG. 6), any continued downward force will be transmitted via ledge 64 and sleeve portion 26 to top wall 21 of the case 20. If, however, a bending of either the platen panel 11 or the case wall 21 would occur under the downward force, the stamped imprint obtained would deviate from normal quality, and likely be too dark or blurred. While the rigidity required to obviate such bending could be secured by making the platen and the case wall with greater thickness, or making them of especially strong plastic material, the cost and other qualities of the stamp mount would thus be adversely affected.

Figure 7:
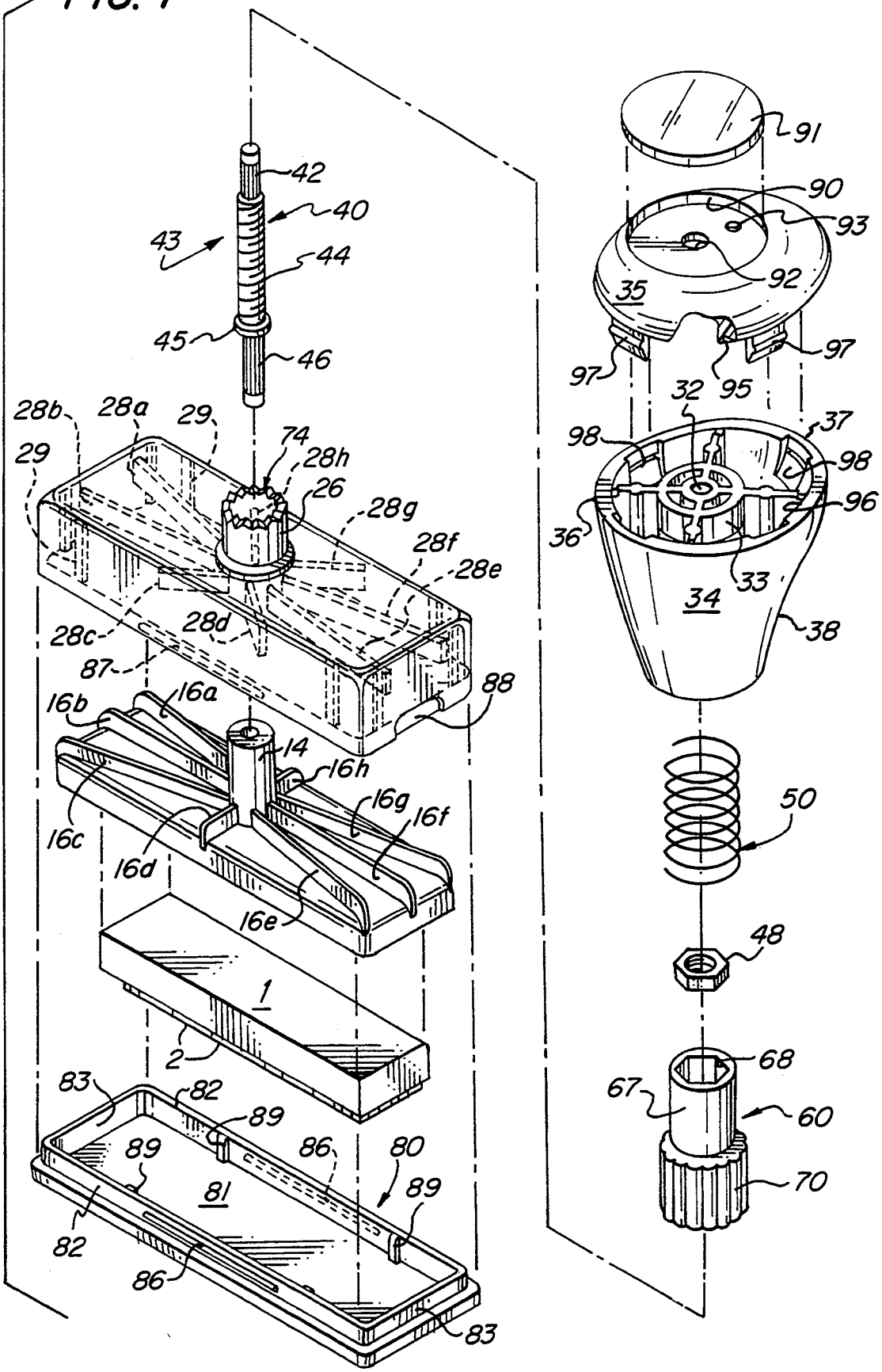
FIG. 7 is an exploded view of the parts of a stamp mount according to the embodiment of FIGS. 1–6.

According to another feature of the invention, as illustrated particularly in FIG. 7 and FIG. 8, the molded platen 10 not only has its main panel 11 made sufficiently large in area to cover the impression member 1 to be employed in the stamp, and has its central or stem-holding portion 14 joined to the lower end portion 46 of stem 40; the main panel 11, additionally, is formed integrally with an array of ribs, designated **16*a* through 16*h*, which protrude upward from its upper side and radiate from the stem-holding portion 14 over substantially the entire area of the panel. These upstanding ribs so radiating stiffen the platen effectively against bending or other deformation by force applied to it in practically any direction through the stem 40**.

Further, the top wall 21 of the molded case is also formed integrally with an array of ribs, designated **28*a* through 28*h*, which protrude downward from the under side of wall 21 and radiate from sleeve portion 26 of the case over substantially the entire area of wall 21. These depending ribs so radiating stiffen the case effectively against bending or other deformation by force applied to it in practically any direction through the stem 40, stop member 48, ledge 64 and sleeve portion 26**.

Still further, as may be seen in FIG. 8, the depending ribs on the top wall 21 of the case are located in horizontally spaced relation to the upstanding ribs on the platen panel 11 so that when the platen 10 is in its normal upward position adjacent to wall 21 the respective sets of radiating ribs occupy vertical space in common without any of the ribs substantially contacting another of them. Thus, there is an intercalation of the radiating ribs that enables effective reinforcement of both the platen and the case without need for an increase of the overall case height beyond that which would be required for ribs of similar height on only one of these parts.

Reference has been made to the top wall 21 and side and end panels 22–25 of the case 20. These structures leave the lower side of the case open for downward movement of the impression member 1. When the stamp is awaiting use or in storage, however, a cover 80 may and should close the lower end of the case to keep a preinked impression member 1 away from free air and prevent it from soiling a hand or other object contacting the stamp.

The cover 80 is a molded part comprising a bottom panel 81 formed integrally with upstanding opposite side flanges 82 and end flanges 83. These flanges fit beside and against respective marginal portions 84 and 85 of the side panels and end panels of the case. Each of the side flanges 82 has a narrow elongate beading 86 protruding laterally from it along an intermediate portion of its length, and each of the respective marginal portions 84 of the case side panels has a narrow elongate groove 87 formed therein along an intermediate portion of its length, to receive and interlock with the beading 86 on the related cover flange 82.

The beadings 86 when seated in the grooves 87 resist removal of the cover 80 from the case 20 by downward pressure of the platen 10 against the cover; yet they enable easy removal of the cover by modest downward force applied to an end of the cover and thus acting angularly on the beadings. A shallow niche 88 can be provided in each end panel of the case to guide a person's finger to an end edge of the cover for pressing it downward.

Figure 5:
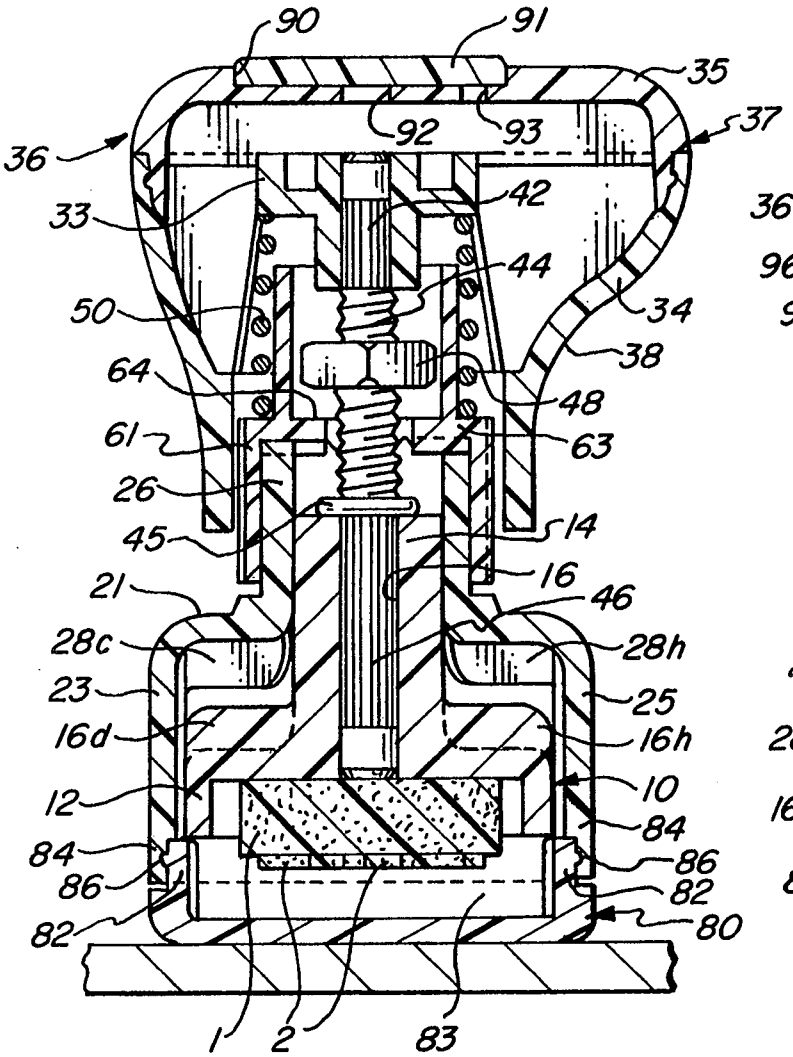
FIG. 5 is a transverse vertical cross-sectional view of the mount device of FIG. 1, showing its handle in the form of a knob having an asymmetric rounded portion protruding backward from a portion rounded to fit in the palm of a user's hand.

The side and end flanges 82 and 83 of the cover 80, as may be seen in FIG. 1 and FIG. 5, of the drawings preferably fit inside the side and end panels of the case and present inwardly projecting portions, including for instance integral ribs 89, which lie in the path of and obstruct downward movement of the platen 10 when the cover is in place on case 20. If the handle assembly of the stamp happens to be pushed down when the cover 80 is in place, such inwardly projecting portions will stop the downward motion of the platen and thus prevent indicia of the impression member from contacting and applying ink to the inner surface of the cover.

At a plurality of locations on the inside of the case 20, for instance, at eight such locations as indicated in FIG. 1 and FIG. 7, vertically extending ribs 29 are provided which occupy space between the side and end panels of the case and the side and end flanges 12 of the platen. These ribs keep the platen positioned correctly relative to the case during all operations of the stamp, thus avoiding a feel of looseness or "shake" that otherwise might occur in its use.

According to a further feature of the invention, the handle 30 of the stamp is made in the configuration of a knob having a front portion 36 that is rounded to fit into the palm of a user's hand, and having an asymmetric rounded portion 37 protruding backward for being grasped in fingers of the hand. The handle body 34 is fixed non-rotatably to upper end portion 42 of the stem 40, and the stem in turn is fixed non-rotatably to the platen that carries the stamp's impression member.

Since the asymmetric backwardly protruding rounded portion 37 of the knob, sensibly to a user's hand, extends farther away from the axis of the stem than does the rounded front portion 36, and has a more inwardly sloped lower surface area 38 (FIG. 5), thus being concavely curved in vertical direction and convexly curved in horizontal direction while other surfaces of the knob are convexly curved in both directions, a front-to-back orientation of the handle knob can be readily sensed by the feel of the knob in a user's hand. The knob is so fixed to the stem that its front-to-back orientation corresponds to the desired orientation of imprints of the indicia to be provided on the impression member 1 of the stamp. Consequently, instead of needing to look at the stamp to be sure of positioning it correctly for use, its orientation required for making a right-reading imprint can be obtained reliably by a user's sensing of the feel of the handle knob.

Referring again to FIG. 7, it will be seen that the cap 35 of handle 30 is formed in its upper side with a recess 90 into which a close-fitting top member 91 is inserted. The recess and top member may be circular or of another desired shape. The top member may be transparent, to display through it a legend or marking placed beneath it in the recess: or it may be opaque and provided with a legend or marking on its outer side.

It will be noted that the wall forming cap 35 has two holes 92 and 93 extending through it in its recessed area. The larger hole 92 is used on assembly of the handle to locate the cap correctly relative to other parts, with aid from the smaller hole 93 to assure proper orientation of the asymmetric cap 35 relative to handle body 34. Additionally, hole 93 enables an implement passed through it to pop the top member 91 out of its recess 90 if a change of member 91 or of a legend displayed through it is required. Such popping out is facilitated by the off-center location of hole 93.

The handle cap 35 is formed with a downwardly directed peripheral lip 95 that fits inside a peripheral upper edge portion 96 of the handle body 34. Resilient latch elements 97 molded with the cap extend downward at several locations spaced apart about its periphery, and are each engaged releasably with a mating latch structure 98 formed inside the handle body near its upper edge. The cap can be removed simply by forcing an edge of it up from the handle body 34 so as to spring one or more of the latch elements 97 free of the mating latch structures.

Figure 10:
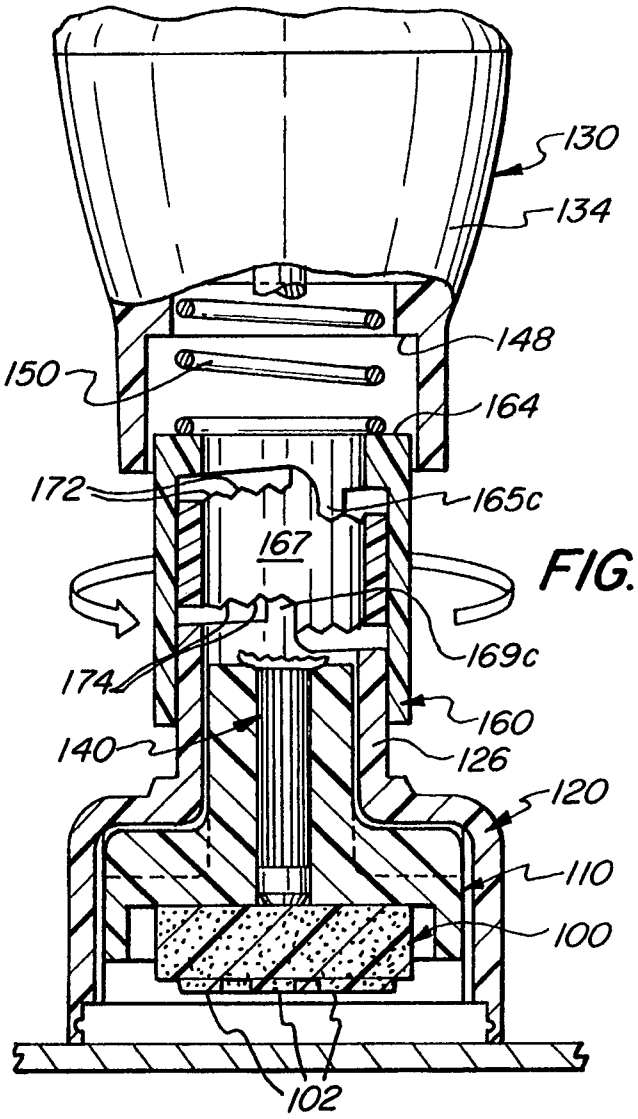
FIG. 10 is a view similar to that of FIG. 9 put showing the stroke adjusting system in a different condition of adjustment to provide increased displacement and compression of the impression member.
Figure 9:
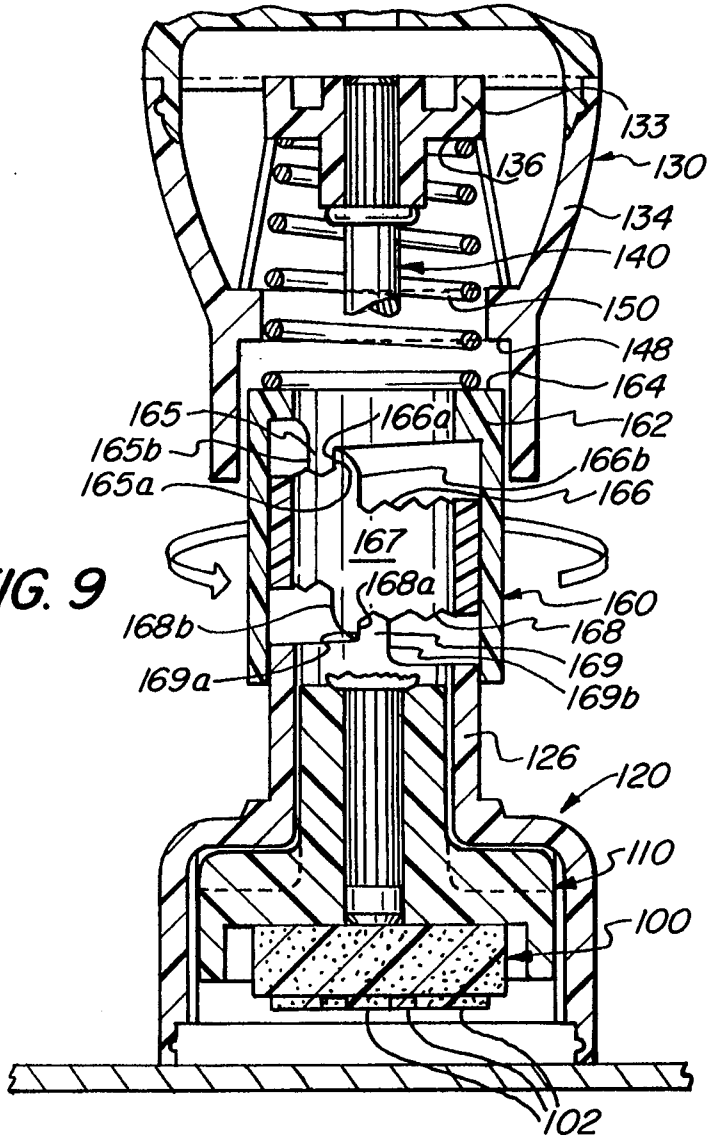
FIG. 9 is a vertical longitudinal cross-sectional view of another embodiment of the invention, in which adjustment of the location of a stroke limiting stop member in response to turning of an adjuster is effected by a system of followers engaged with helical ramp surfaces.
Figure 11:
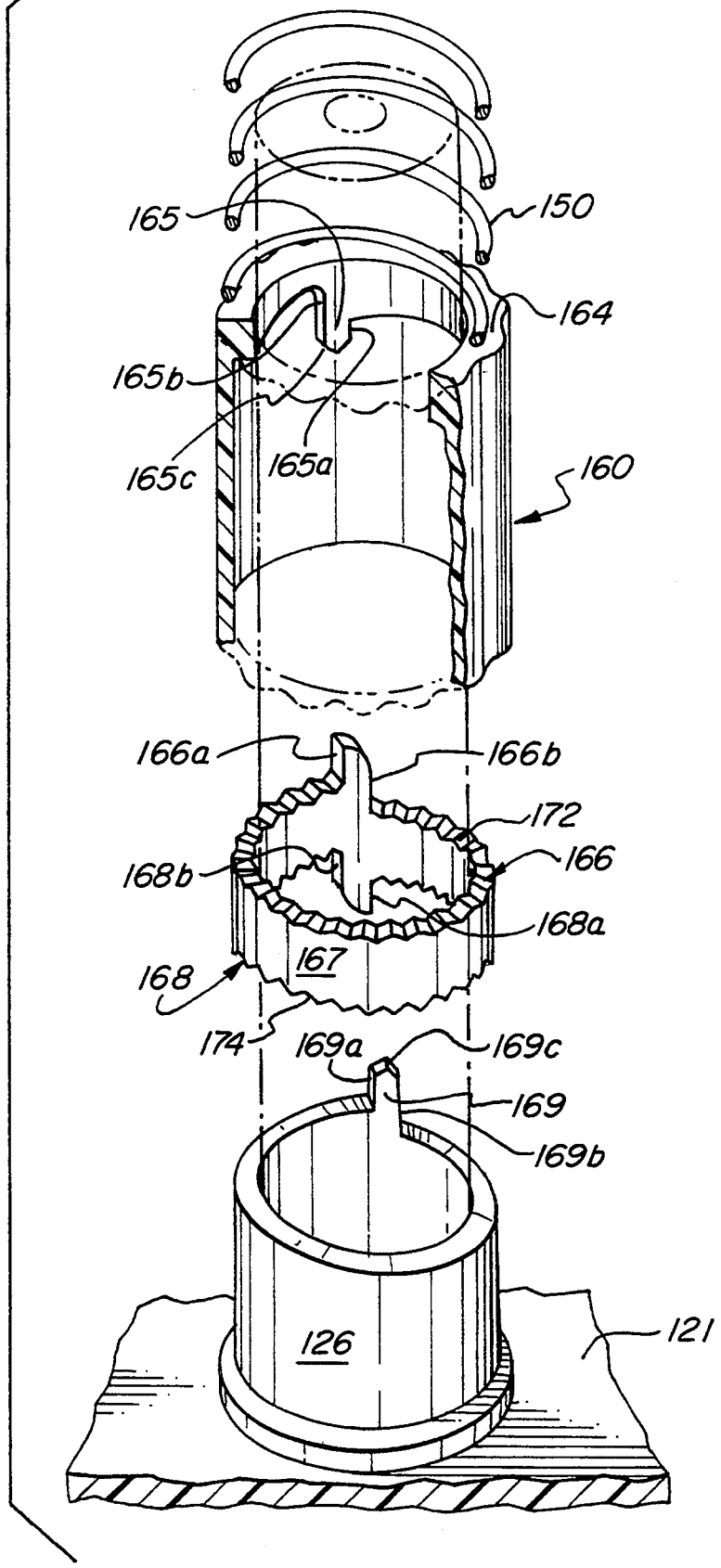
FIG. 11 is an exploded view of parts of the stroke adjusting system of FIGS. 9 and 10.

In a further embodiment of the invention, as illustrated, for example, in FIGS. 9–11 of the drawings, a platen 110 for carrying an impression member 100, a case 120, and a handle 130 may correspond substantially to parts 10, 1, 20 and 30, respectively, of the stamp mount described above. A stem 140 interconnects the handle 130 and the platen 110 and extends through a sleeve portion 126 of the case, substantially as described above and illustrated in respect of stem 40, handle 30, platen 10 and case sleeve portion 26.

The stem 140, however, does not have an intermediate portion thereof formed with an external spiral screw thread; no threaded part is needed or employed in the stamp mount device of FIGS. 9–11. Additionally, the coacting stop members 148 and 164 in this device differ in form and location from the above-described stop members 48 and 64, and a different system is provided for displacing one of the stop members, i.e., member 164, lengthwise of the stem in response to turning of an adjuster 160 about the stem.

Adjuster 160 is like adjuster 60 in that it is substantially cylindrical, is normally held seated relative to the upstanding sleeve portion 126 of the stamp's case 120, and is turnable about that sleeve portion, so also about stem 140, by fingers of a user's hand.

Adjuster 160 has an upper portion 162 that itself presents and peripherally surrounds the adjustably located stop member 164 as an upwardly facing annular surface, or shoulder, thereof which is turned about and displaced lengthwise of the stem 140 upon turning of the adjuster.

The coacting stop member 148 in turn is constituted by a downwardly facing annular surface, or ledge, formed inside handle body 134 in confronting relation to stop surface 164.

The top of the adjuster's upper portion 162 provides a seat that supports the lower end of a coiled wire spring 150 which is compressed between that seat and a seat 136 on support structure 133 inside the handle body 134. Thus, the spring constantly presses the handle 130 upward while constantly pressing the adjuster downward in firm engagement with the structures supporting it on the sleeve portion 126 of case 120. The adjuster's upper portion 162 presents also, at its inner side, a downwardly protruding formation 165, termed a "follower", that supports the adjuster and constitutes part of the means provided for displacing the adjuster, so stop member 164, lengthwise of the stem in response to turning of the adjuster.

Follower 165 bears downward against an upper helical surface 166 of a ramp member 167 that is positioned inside a cylindrical lower portion of the adjuster 160 and has on and about its lower end a second helical surface 168 bearing downward against a second follower 169. Follower 169 protrudes upward from the top of sleeve portion 126 of case 120.

The ramp member 167 could be given any of various forms but as shown has the form of a cylindrical ring molded with the helical ramp surfaces 166 and 168 on and extending about its opposite ends. The upper helical surface 166 extends over somewhat less than a 360° turn about the longitudinal axis of stem 140, from an axial stop surface **166*a* at its upper end helically downward to an axial stop surface 166*b* at its lower end. The stop surfaces 166*a* and 166*b* are positioned to butt, respectively, against substantially axial surfaces 165*a* and 165*b* on opposite sides of follower 165**.

Similarly though conversely, the second helical surface 168 extends over somewhat less than a 360° turn about the longitudinal axis of the stem, from an axial stop surface **168*a* at its lower end to an axial stop surface 168*b* at its upper end; and the stop surfaces 168*a* and 168*b* are formed to butt, respectively, against substantially axial surfaces 169*a* and 169*b* on opposite sides of the second follower 169**.

Each of the followers 165 and 169 has an end portion 165*c*, or 169*c*, that is formed to fit and normally is held releasably engaged between adjacent detents 172 or 174 of the respective helical ramp surface yet is selectively engageable in positions between others of such detents by a turning of the adjuster 160.

The fit of each follower's end with the detents of the mating helical ramp surface and the pressure between them as constantly applied from spring 150 are such that precise increments of any turning movement of the adjuster are readily sensible to a user of the stamp device. A movement of either of the followers 165 and 169 relative to its set of detents 172 or 174, or movement of the detents relative to the follower engaging them, gives the user a sensible feel and clicking indication of each increment of turning movement of the adjuster.

The manner of operation of the stroke adjusting system of FIGS. 9–11 will now be evident. In FIG. 9, the adjustable stop member 164 on adjuster 160 is shown in an uppermost position relative to the reciprocable assembly of handle 130, platen 110 and stem 140; so a short stamping stroke with relatively little compression of the indicia 102 on impression member 100 will be provided by movement of the handle assembly downward until stop member 148 butts against stop member 164.

In the uppermost position of stop member 164, adjuster 160 has been turned clockwise so far that follower surface 165*a* has butted against ramp member surface 166*a*, and so much farther with those surfaces butted that ramp member 167 has been turned to a position in which its stop surface 168*a* is butted against the radial surface 169*a* of follower 169 protruding upward from the case's sleeve portion 126.

FIG. 10 illustrates a lowermost position of adjustment of the displaceable stop member 164 relative to stop member 148, corresponding to a maximum stroke length of the handle assembly and, thus, to a maximum compression of the indicia 102 and impression member 100. This position has been reached by counterclockwise movement of adjuster 160 and follower 165 thereon over a distance somewhat less than 360° from the position shown in FIG. 9, thus traversing the detents 172 on helical ramp surface 166 and bringing axial surface 165*b* on the adjuster into engagement with axial surface 166*b* on ramp member 167. Then, with further adjustment to compensate for progressive reduction of the ink supply available from pad 100, the follower surface 165*b* engaged against radial surface 166*b* of the ramp member 167 displaces member 167 and the helical row of detents 174 on it counterclockwise over follower 169 until axial surface 168*b* on member 167 butts against follower surface 169*b* as illustrated in FIG. 10.

It will be apparent that nearly two full turns of the adjuster 160 are available for displacing stop member 164 either upward or downward between its limiting position illustrated in FIG. 9 and its limiting position illustrated in FIG. 10. For operation of the stamp device, the stop member 164 can be disposed, however desired, at any of as many locations lengthwise of the stem 140 as there are positions of engagement of the followers 165 and 169 between detents in the helical ramp surfaces 166 and 168.

A modification of the embodiment shown in FIGS. 9–11 is illustrated in FIG. 12 of the drawings. Here ,the arrangement is modified so that a cylindrical outer member of the adjuster is not displaced axially relative to the case 220 or its upstanding sleeve portion 226; so neither a displaceable stop member nor an upper ramp follower is provided as part of that outer member. Instead, the outer member has an interlocking engagement with sleeve portion 226 of the case, such, for example, as by a beading 227 on the latter engaging in a recess inside the outer member of adjuster 260, so that the adjuster can be turned about but normally will not move axially relative to sleeve portion 226. Then, for the adjusting function, the upper portion of the adjuster comprises a ring member 262 disposed inside the upper end of the outer cylindrical member, and axial splines 263 or other suitable means join ring member 262 loosely with the outer member of the adjuster so that member 262 will be turned with yet is displaceable axially relative to the outer member.

Ring member 262 has a follower 265 protruding downward from it. Follower 265 is seated on and turnable about an upper helical ramp surface 266 of a ramp member 267, similar to member 167 described above, which in turn has a second helical surface 268 seated on and turnable relative to a follower 269 that protrudes upward from the upper end of sleeve portion 226. Each of the ramp surfaces 266 and 268 preferably is formed with angled detents therealong to engage the end of the related follower between any two of the detents, and to give sensible indications of definite increments of movement of the adjuster 260, as described above with reference to ramp surfaces 166 and 168.

As shown in FIG. 12, the stamp's handle assembly normally is held in an upward, idle position by a coiled spring 250 which is compressed between a rigid internal structure 233 of the handle body 234 and the upper end of ring member 262. The spring 250 normally holds ring member 262 pressed downward against ramp member 267, with member 267 pressing downward against the relatively fixed follower 269.

When the handle assembly is pressed down in use of the stamp device to make an imprint, the spring 250 is further compressed until a stop member 248 integral with the handle body's internal structure 233 butts against a stop member constituted by an upwardly facing top surface 264 of ring member 262. Surface 264 corresponds in relative location and function to the stop member surface 164 on the upper end of adjuster 160 in the embodiments of FIGS. 9–11.

The distance of the downward stoke of the handle assembly is determined by the position of adjustment of surface 264 on ring member 262 relative to stop member 248 in the handle body; hence, relative to stem 240 and the platen carrying the impression member of the stamp. That distance, or stroke length, is adjustable to any desired extent within the range of the variations of it provided by the slopes of the ramp surfaces 266 and 268 upon incremental turnings of the adjuster 260. As in the embodiment of FIGS. 9–11, nearly two full turns of the adjuster about the axis of stem 240 are available for the stroke length adjustments.

The foregoing detailed description and the drawings are illustrative of presently preferred ways of carrying out the invention. Various other ways and means may be employed for carrying out and achieving advantages of the invention. The invention therefore is not to be considered limited to particulars herein described or illustrated in the drawings except as may be required for fair interpretation of the appended claims.

We claim:

1. In a mount for a stamp impression member adapted to imprint surfaces to be marked, including:

a platen to support and carry the impression member;

a case to house the platen with such impression member mounted thereon;

a handle disposed upward of said case;

a stem substantially rigidly interconnecting said handle and said platen, forming a reciprocable assembly therewith, and extending through a top portion of said case;

a spring normally holding said assembly in an upward position in which the platen and a said impression member when on the platen are disposed inside said case, said assembly being displaceable downward against said spring by pressure on said handle to mark a surface underlying said case;

a stop member constituted by a part of said assembly inside said handle and a coacting stop member constituted by a structure normally held seated relative to an upper portion of said case, said stop members being spaced apart in said upward position of said assembly and upon downward displacement of said assembly abutting each other to stop such displacement, one of said stop members being adjustable in location lengthwise of said stem to change the permitted distance of such displacement;

an adjuster turnable about said stem and having an upper portion that peripherally surrounds said one stop member and upon turning of said adjuster correspondingly turns said one stop member about said stem; and means responsive to such turning for substantially proportionately displacing said one stop member lengthwise of said stem.

2. A stamp mount according to claim 1, said stem having an intermediate portion thereof formed with an external thread extending spirally thereabout and therealong, said one stop member being an internally threaded polygonal nut turnable about and along said stem on said thread;

said upper portion of said adjuster having an upright inner surface of polygonal cross section for engaging said nut to control the location of said nut on said thread yet, by being spaced outward from said thread, forming an upright pathway for adjustment of the nut's location lengthwise of said stem and for free movement of said nut to and from the other of said stop members upon reciprocation of said assembly.

3. A stamp mount according to claim 2, said other stop member comprising a ledge portion of said adjuster extending inward from an intermediate portion thereof to underlie said nut at the lower end of said pathway.

4. A stamp mount according to claim 2, said stem being a length of heavy wire; said thread being a thread-rolled formation of an intermediate portion of said length of wire.

5. A stamp mount according to claim 4, further comprising sockets formed respectively in an inner portion of said handle and a central portion of said platen, said length of wire having portions thereof near its opposite ends force-fitted tightly into said sockets.

6. A stamp mount according to claim 1, further comprising:

said case being a molded body comprising a top wall adapted to overlie said platen in close proximity thereto when said assembly is in its said upward position, said top wall having a sleeve portion to receive said stem-holding portion of said platen, and being formed integrally with ribs protruding downward from its under side and substantially radiating from said sleeve portion over substantially the area of said top wall to stiffen said case against deformation by force applied to it through said assembly.

7. A stamp mount according to claim 1, further comprising:

said platen being a molded body comprising a panel sufficiently large in area to cover said impression member and having a stem-holding portion joined to the lower end of said stem, said panel being formed integrally with ribs protruding upward from its upper side and substantially radiating from said stem-holding portion over substantially the area of said panel to stiffen the platen against deformation by force applied to it through said stem;

said case being a molded body comprising a top wall adapted to overlie said platen in close proximity thereto when said assembly is in its said upward position, said top wall having a sleeve portion to receive said stem-holding portion of said platen, and being formed integrally with ribs protruding downward from its under side and substantially radiating from said sleeve portion over substantially the area of said top wall to stiffen said case against deformation by force applied to it through said assembly;

said ribs of said top wall of said case extending along locations spaced from the locations of said ribs of said platen panel so that in said upward position of said platen the radiating ribs of the respective sets thereof are disposed horizontally side-by-side and occupy vertical space in common without substantially contacting one another.

8. A stamp mount according to claim 1, said case comprising a top wall having an upstanding sleeve portion, said adjuster comprising a substantially cylindrical part encompassing and turnable about said sleeve portion, said one stop member comprising an upwardly facing surface that is turnable about and displaceable lengthwise of said stem by said means responsive to turning of said adjuster.

9. A stamp mount according to claim 8, said handle having formed integrally with an inside wall portion thereof presenting a downwardly facing ledge constituting the other of said stop members.

10. A stamp mount according to claim 8, said means for displacing said one stop member including at least one helical ramp surface each extending over somewhat less than a 360° turn about said stem and a follower bearing against each said ramp surface and being variably positionable along it by a turning of said adjuster.

11. A stamp mount according to claim 10, each said helical ramp surface being formed therealong with a multiplicity of angled detents disposed transverse thereto, each said follower having an end portion formed to fit and normally held releasably engaged between adjacent ones of said detents yet being selectively engageable in positions between others of them by turning of said adjuster.

12. A stamp mount according to claim 8, said means for displacing said one stop member including a ramp member disposed between the upper end of said sleeve portion and an upper portion of said adjuster, said ramp member presenting an upwardly directed, first helical ramp surface extending over somewhat less than a 360° turn about said stem and a downwardly directed second helical ramp surface extending over somewhat less than another 360° turn thereabout, said ramp surfaces each leading to a substantially axial stop surface at each of its ends; a first ramp follower extending downward from said upper portion of said adjuster and bearing against and being turnable upon and along said first ramp surface up to a point of abutment of said follower with a said stop surface at the lower end of said first ramp surface, said follower upon further turning of said adjuster then being turned further with the abutted stop surface and corresponding turning of said ramp member; and a second ramp follower extending upward from said sleeve portion end and engaging said second ramp surface so that by such further turning said ramp member is turnable upon and displaceable axially relative to said second follower up to a point of abutment with said second follower of a said stop surface at the lower end of said second ramp surface.

13. A stamp mount according to claim 12, said upwardly facing surface being on and inside the periphery of said upper portion of said adjuster.

14. A stamp mount according to claim 12, said adjuster comprising a substantially cylindrical outer member and a ring member disposed inside and connected for turning movement with an upper portion of said outer member, said upwardly facing surface and said first ramp follower being parts of said ring member, said ring member being displaceable axially relative to said outer member, being pressed downwardly by said spring, and being positioned lengthwise of said stem according to the positions of said followers on said helical ramp surfaces.

15. In a mount for a stamp impression member adapted to imprint surfaces to be marked, including:

a platen to support and carry the impression member;

a case to house the platen with such impression member;

a handle disposed upward of said case;

a stem interconnecting said handle and said platen, forming a reciprocable assembly therewith, and extending through a top portion of said case; and a spring normally holding said assembly in an upward position in which the platen and a said impression member are disposed inside said case, said assembly being displaceable downward against said spring by pressure on said handle to mark a surface underlying said case;

said case having a top wall formed integrally with opposite side panels and opposite end panels, which panels surround said platen and extend downward about an open lower side of said case to bear on a surface to be marked; and a cover to close said lower side, said cover comprising a bottom panel formed integrally with upstanding opposite side flanges and opposite end flanges, which flanges respectively fit beside and against respective marginal portions of said side panels and end panels;

said opposite side flanges each having a narrow elongate beading protruding laterally from it along an intermediate portion only of its length, and said marginal portions of said opposite side panels each having a narrow groove formed therein along an intermediate portion only of its length to receive and interlock with one of said beadings; said beadings when seated in said grooves resisting removal of said cover from said case by downward force of said platen against said cover yet enabling such removal by modest downward force applied to an end of said cover and thus acting angularly on said beadings.

16. A stamp mount according to claim 15, said flanges fitting inside said panels; said flanges having portions thereof standing inward and upward sufficiently that when said cover is in place such portions lie in the path of and will obstruct downward movement of said platen to prevent said impression member from being pressed against the inner surface of said cover.

17. In a mount for a stamp impression member adapted to imprint surfaces to be marked, including:

a platen to support and carry the impression member;

a case to house the platen with such impression member;

a handle disposed upward of said case;

a stem interconnecting said handle and said platen, forming a reciprocable assembly therewith, and extending through a top portion of said case; and a spring normally holding said assembly in an upward position in which the platen and a said impression member are disposed inside said case, said assembly being displaceable downward against said spring by pressure on said handle to mark a surface underlying said case;

the improvement wherein said handle comprises a knob having a front portion .the surface of which is convexly rounded in both the vertical and the horizontal directions to fit into the palm of a user's hand, and having an opposite asymmetric rounded backward portion protruding further from said stem than said front portion for being grasped in fingers of the hand, said backward portion comprising an upper surface portion convexly curved in both said directions and a lower surface portion curved convexly in horizontal direction and concavely in vertical direction;

said platen, said stem and said handle being rigidly interconnected in a fixed relative orientation with said asymmetric portion of said knob protruding in a direction away from the front of the mount such that by the feel of said knob in one's hand said platen may be oriented reliably for stamping right-reading imprints of an impression member mounted on the platen.

18. In a mount for a stamp impression member adapted to imprint surfaces to be marked, including:

a platen to support and carry the impression member;

a case to house the platen and such impression member;

a handle disposed upward of said case;

a stem interconnecting said handle and said platen, forming a reciprocable assembly therewith, and extending through an upper portion of said case;

means normally holding said assembly in an upward position in which the platen and a said impression member when on the platen are disposed inside said case, said assembly being displaceable downward by pressure on said handle to mark a surface underlying said case;

a stop member constituted by a part of said assembly inside said handle and a coacting stop member constituted by a structure normally held seated relative to an upper portion of said case, said stop members being spaced apart in said upward position of said assembly and upon downward displacement of said assembly abutting each other to stop such displacement, one of said stop members being adjustable in location lengthwise of said stem to change the permitted distance of such displacement;

an adjuster turnable about said stem and having an upper portion that peripherally surrounds said one stop member and upon turning of said adjuster correspondingly turns said one stop member about said stem; and means responsive to such turning for substantially proportionately displacing said one stop member lengthwise of said stem;

said stem having an intermediate portion thereof formed with an external thread extending spirally thereabout and therealong, said one stop member being an internally threaded nut turnable about and along said stem on said thread;

said platen being a molded body of hard resilient material comprising a panel thereof sufficiently large in area to cover a said impression member and having a stem-holding portion joined to the lower end of said stem, said panel being formed integrally with ribs protruding upward from its upper side and substantially radiating from said stem-holding portion over substantially the area of said panel to stiffen the platen against deformation by force applied to it through said stem;

said case being a molded body of hard resilient material comprising a top wall thereof adapted to overlie said platen in close proximity thereto when said assembly is in its said upward position, said top wall having a sleeve portion to receive said stem-holding portion of said platen, and being formed integrally with ribs protruding downward from its under side and substantially radiating from said sleeve portion over substantially the area of said top wall to stiffen said case against deformation by force applied to it through said assembly;

said ribs of said top wall of said case extending along locations spaced from the locations of said ribs of said platen panel so that in said upward position of said platen the radiating ribs of the respective sets thereof are disposed horizontally side-by-side and occupy vertical space in common without substantially contacting one another;

said case top wall being formed integrally with opposite side panels and opposite end panels, which panels surround said platen about an open lower side of said case to bear on a surface to be marked; and a cover to close said lower side, said cover comprising a bottom panel formed integrally with upstanding opposite side flanges and opposite end flanges, which flanges respectively fit inside respective marginal portions of said side panels and end panels; said flanges having portions thereof standing inward and upward sufficiently that when said cover is in place said standing portions lie in the path of and will obstruct downward movement of said platen to prevent said impression member from being pressed against the inner surface of said case;

said opposite side flanges each having a narrow elongate beading protruding laterally from it along an intermediate portion of its length, and said marginal portions of said opposite side panels each having a narrow groove formed therein along an intermediate portion of its length to receive and interlock with one of said beading, said beadings when seated in said grooves resisting removal of said cover from said case by downward force of said platen against said cover yet enabling such removal by modest downward force applied to an end of said cover and thus acting angularly on said beadings;

said handle comprising a knob having a front portion rounded to fit into the palm of a user's hand and having an asymmetric rounded portion protruding backward for being grasped in fingers of the hand; said platen, said stem and said handle being rigidly interconnected in a fixed relative orientation with said asymmetric portion of said knob protruding in a direction away from the front of the stamp mount such that by the feel of said knob in one's hand said platen may be oriented reliably for stamping right-reading imprints of an impression member mounted on the platen.

19. A stamp mount according to claim 18, said asymmetric rounded portion being constituted by an upper surface portion convexly curved in both vertical and horizontal directions and a lower surface portion curved concavely in vertical direction and convexly in horizontal direction.

20. In a mount for a stamp impression member adapted to imprint surfaces to be marked, including:

a platen to support and carry the impression member;

a case to house the platen with such impression member;

a handle disposed upward of said case;

a stem interconnecting said handle and said platen, forming a reciprocable assembly therewith, and extending through a top portion of said case; and a spring normally holding said assembly in an upward position in which the platen and a said impression member are disposed inside said case, said assembly being displaceable downward against said spring by pressure on said handle to mark a surface underlying said case;

said platen being a molded body comprising a panel sufficiently large in area to cover said impression member and having a stem-holding portion joined to the lower end of said stem, said panel being formed integrally with ribs protruding upward from its upper side and substantially radiating from said stem-holding portion over substantially the area of said panel to stiffen the platen against deformation by force applied to it through said stem;

said case being a molded body comprising a top wall adapted to overlie said platen in close proximity thereto when said assembly is in its said upward position, said top wall having a sleeve portion to receive said stem-holding portion of said platen, and being formed integrally with ribs protruding downward from its under side and substantially radiating from said sleeve portion over substantially the area of said top wall to stiffen said case against deformation by force applied to it through said assembly;

said ribs of said top wall of said case extending along locations spaced from the locations of said ribs of said platen panel so that in said upward position of said platen the radiating ribs of the respective sets thereof are disposed horizontally side-by-side and occupy vertical space in common without substantially contacting one another.

* * * * *